US008024998B1

(12) United States Patent
Valencia

(10) Patent No.: US 8,024,998 B1
(45) Date of Patent: Sep. 27, 2011

(54) LOCKING PLIERS FOR BEING ONE-HANDED ADJUSTABLE, CLAMPABLE, AND RELEASABLE

(76) Inventor: Pablo D. Valencia, Artesia, NM (US)

( * ) Notice: Subject to any disclaimer, the term of this patent is extended or adjusted under 35 U.S.C. 154(b) by 291 days.

(21) Appl. No.: 12/378,552

(22) Filed: Feb. 17, 2009

(51) Int. Cl.
*B25B 7/12* (2006.01)

(52) U.S. Cl. ..... 81/368

(58) Field of Classification Search ..... 81/367–384, 81/388–389, 395, 398–399, DIG. 5
See application file for complete search history.

(56) References Cited

U.S. PATENT DOCUMENTS 2,592,803 A 4/1952 Heim
2,842,996 A 7/1956 Coslow et al.
2,800,823 A * 7/1957 Tugend ..... 81/370
4,820,901 A 4/1989 Peviani
4,889,022 A 12/1989 Peviani
5,609,080 A 3/1997 Flavigny
6,164,107 A * 12/2000 Korba, Jr. ..... 72/31.1
6,450,070 B1 9/2002 Winkler et al.
6,862,961 B2 3/2005 Winkler
2002/0162427 A1 11/2002 Peperkorn et al.
2004/0255729 A1 12/2004 Poole et al.
2007/0180957 A1 8/2007 Johnson

* cited by examiner

*Primary Examiner* — Debra S Meislin
(74) *Attorney, Agent, or Firm* — Richard L. Miller

(57) ABSTRACT

Locking pliers for being one-handed adjustable, clampable, and releasable. The locking pliers includes a fixed portion, a movable portion, a first apparatus for moving the movable portion relative to the fixed portion a desired amount in order to clamp a workpiece using only one hand, and a second apparatus for releasing the movable portion from the fixed portion in order to release the workpiece using only the one hand. The movable portion is movably connected to the fixed portion. The first apparatus is operatively connected to the fixed portion. The second apparatus is operatively connected to the movable portion.

13 Claims, 6 Drawing Sheets

Fig. 11
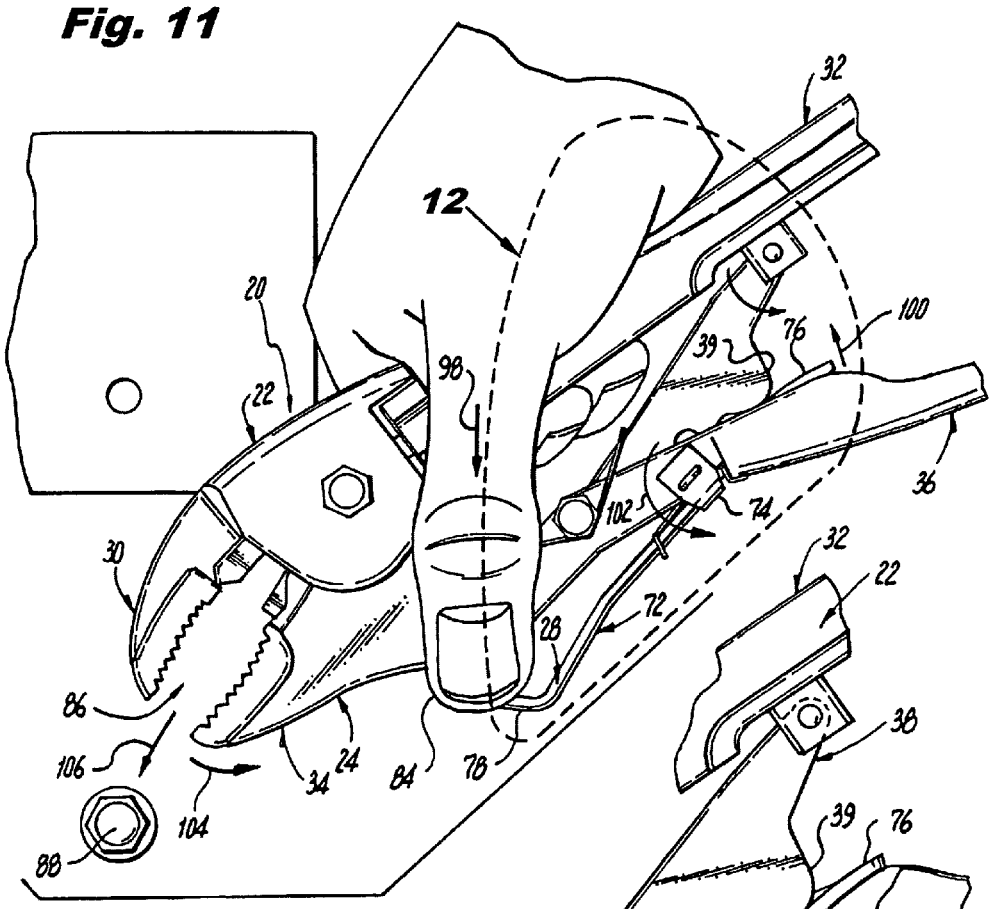
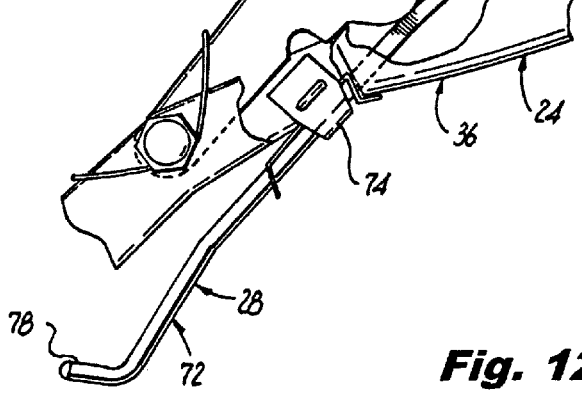
Fig. 12

LOCKING PLIERS FOR BEING ONE-HANDED ADJUSTABLE, CLAMPABLE, AND RELEASABLE

1. THE BACKGROUND OF THE INVENTION

A. The Field of the Invention

The embodiments of the present invention relate to locking pliers, and more particularly, the embodiments of the present invention relate to locking pliers for being one-handed adjustable, clampable, and releasable.

B. The Description of the Prior Art

The art is sated with various self-locking adjustable pliers wrenches for gripping and locking onto objects within a rather wide size range. The innovations in these pliers are marked largely by improvements to the toggle mechanisms that permit the jaws to not only accommodate differently sized objects, but also to lock onto the objects with varying degrees of force. Existing toggle mechanisms employ an adjustment component for use in adjusting the distance between the jaws so that they can grip and lock onto differently sized objects. The jaws must be pre-adjusted so that they can engage and grip an object, regardless of the size. As a result, existing self-locking adjustable pliers wrenches cannot be used with only one hand in the sequential gripping of differently sized objects because a pre-adjustment of the jaws is required from the gripping of one object to the gripping of another differently sized object.

This required pre-adjustment of the jaws in the sequential gripping of differently sized objects is a significant deficiency in the art, and it is clear that a adjustable wrench that could be employed for sequentially gripping differently sized objects with a selected gripping force without having to be sequentially pre-adjusted would mark a significant improvement over the prior art.

Thus, there exists a need for locking pliers that is easy to employ with only one hand, especially for sequentially gripping differently sized objects without the need for sequentially pre-adjusting the jaws.

Numerous innovations for locking pliers have been provided in the prior art, which will be described below in chronological order to show advancement in the art, and which are incorporated herein by reference thereto. Even though these innovations may be suitable for the specific individual purposes to which they address, however, they differ from the present invention in that they do not teach locking pliers for being one-handed adjustable, clampable, and releasable.

(1) U.S. Pat. No. 2,592,803 to Heim.

U.S. Pat. No. 2,592,803 issued to Heim on Apr. 15, 1952 in U.S. class 81 and subclass 84 teaches a wrench having a relatively stationary handle with a non-movable jaw mounted upon one end thereof. A movable jaw is secured to a jaw mounting plate which is pivotally mounted upon a first pivot pin intermediate the ends of the stationary handle and adapted to carry the movable jaw into operative relationship with the non-movable jaw. An adjusting apparatus is mounted in the stationary handle and is adapted to adjust the movable jaw in relationship to the non-movable jaw. A second pivot pin passes through the jaw mounting plate and is spaced from the first pivot pin. A locking handle is pivoted at one end upon the jaw mounting plate through the medium of the second pivot pin. A third pivot pin passes through the locking handle intermediate the ends thereof. A toggle link is pivotally secured at one end to the locking handle through the medium of the third pivot pin and at its other end to the adjusting apparatus. The toggle link has a lug formed thereupon adapted to limit the inward movement of the locking handle toward the stationary handle. Another adjusting apparatus mounted upon the locking handle is adapted to cooperate with the lug upon the toggle link to control the amount of adjustment of the movable jaw. A release apparatus interposed between the adjusting apparatus in the stationary handle and the adjacent end of the toggle link is adapted to release the movable jaw from an object after the movable jaw has been clamped upon the object.

(2) U.S. Pat. No. 2,842,996 to Coslow et al.

U.S. Pat. No. 2,842,996 issued to Coslow et al. on Jul. 15, 1958 in U.S. class 81 and subclass 378 teaches a compound leverage, toggle operated plier including a first handle member including a first gripping jaw, a jaw member pivoted on the handle member and including a second gripping jaw opposed to and movable toward the first gripping jaw upon pivotal movement of the jaw member, a second handle member, apparatus rotatably and movably mounting one end of the second handle member on the first handle member for movement of the one end along a given linear path with respect to the first handle member, apparatus rotatably and movably mounting the one end of the second handle member on the jaw member for movement of one end of the second handle member along a linear path with respect to the jaw member inclined relative to the first mentioned path, and apparatus connected between the handle members for moving the one end of the second handle member along the one linear path in a direction to move the second gripping jaw toward the first gripping jaw upon movement of the handle members together.

(3) U.S. Pat. No. 4,820,901 to Peviani.

U.S. Pat. No. 4,820,901 issued to Peviani on Apr. 11, 1989 in U.S. class 219 and subclass 138 teaches a quick releasable clamp for welder's ground and rod connections, which includes a thumb operable release lever releasing an adjustable toggle link. Opposed jaws have toothed engagement buried into a work piece clamped by extended lever arms having resilience for reserved clamping energy, and alternately, the opposed arms have wedging action to position a rod normal to the disposition of the clamp and the cable conductor is anchored remote from its terminal electrical fitting to the frame of the clamp.

(4) U.S. Pat. No. 4,889,022 to Peviani.

U.S. Pat. No. 4,889,022 issued to Peviani on Dec. 26, 1989 in U.S. class 81 and subclass 368 teaches a quick releasable vice-grip pliers that includes a thumb operable release lever releasing an adjustable toggle link. The release lever extends alongside an actuating lever of the pliers and has a finger engageable pad near the pivot pin of the pliers jaws.

(5) U.S. Pat. No. 5,609,080 to Flavigny.

U.S. Pat. No. 5,609,080 issued to Flavigny on Mar. 11, 1997 in U.S. class 81 and subclass 368 teaches locking pliers including a fixed unit of generally elongate shape, which forms at one end a fixed handle and at the other end a fixed jaw. A movable unit includes a movable jaw articulated to the fixed jaw, and an actuating lever of which one end is articulated to the movable jaw and the other end forms a movable handle. Also, a toggle mechanism includes a link articulated to an intermediate point of the lever and extends to a rear bearing point adjustable along the length of the fixed handle. The actuating lever crosses a straight line that joins the articulation of the movable jaw to the bearing point of the link. The fixed handle extends substantially along a straight line joining the articulation to the bearing point.

(6) United States Patent Application Publication Number US 2004/0255729 A1 to Poole et al.

United States Patent Application Publication Number US 2004/0255729 A1 published to Poole et al. on Dec. 23, 2004 in U.S. class 81 and subclass 370 teaches an adjustable pliers wrench including a fixture having a handle, an opposing stationary jaw, a co-acting jaw pivoted to the fixture, and a lever pivoted to the co-acting jaw. A guide is attached proximate the handle and a locking element is arranged on the guide for reciprocal and canting movement. At least one attached biasing element urges the locking element toward the stationary jaw. An arm is pivoted to the lever and a cam is pivoted to the arm and to the locking element so as to be movable between a first condition permitting the locking element to reciprocate along the guide and a second condition bearing against the guide and canting the locking element into frictional engagement against the guide.

(7) U.S. Pat. No. 6,862,961 B2 to Winkler.

U.S. Pat. No. 6,862,961 B2 issued to Winkler on Mar. 8, 2005 in U.S. class 81 and subclass 367 teaches a locking pliers tool combining a self-locking frictional brake, a gap setting apparatus to set jaw gap size automatically when clamping onto a workpiece, an over-center linkage clamping apparatus to securely clamp the workpiece between the opposing tool jaws, and an adjustment apparatus for setting the clamping force to be exerted onto the gripped workpiece.

(8) United States Patent Application Publication Number US 2007/0180957A1 to Johnson.

United States Patent Application Publication Number US 2007/0180957 A1 published to Johnson on Aug. 9, 2007 in U.S. class 81 and subclass 368 teaches a toggle locking tool with an adjustment screw assembly, which includes a force-enhancing shank that enables the holding force of the tool to be multiplied manifold. The adjustment screw assembly includes an adjustment screw conventionally adapted to be fed into and to engage a threaded bore in the outer end of the fixed handle of the tool. The adjustment screw itself, however, includes an internal fine-threaded bore that extends through the length of the screw and receives a threaded force-enhancing shank having a head portion adapted for turning manually or with a turning tool. An end portion of the shank extends beyond the adjustment screw to form the bearing surface which, in a conventional toggle locking tool, is provided by the tip of the adjustment screw. Rotation of the adjustment screw provides rapid low-force locking adjustment of the tool, and subsequent torquing of the force-enhancing shank results in the application of a multiplied locking force to the jaws of the tool.

It is apparent that numerous innovations for locking pliers have been provided in the prior art that are adapted to be used. Furthermore, even though these innovations may be suitable for the specific individual purposes to which they address, however, they would not be suitable for the purposes of the embodiments of the present invention as heretofore described, namely, locking pliers for being one-handed adjustable, clampable, and releasable.

2. THE SUMMARY OF THE INVENTION

Thus, an object of the embodiments of the present invention is to provide locking pliers for being one-handed adjustable, clampable, and releasable, which avoids the disadvantages of the prior art.

Briefly stated, another object of the embodiments of the present invention is to provide locking pliers for being one-handed adjustable, clampable, and releasable. The locking pliers includes a fixed portion, a movable portion, a first apparatus for moving the movable portion relative to the fixed portion a desired amount in order to clamp a workpiece using only one hand, and a second apparatus for releasing the movable portion from the fixed portion in order to release the workpiece using only the one hand. The movable portion is movably connected to the fixed portion. The first apparatus is operatively connected to the fixed portion. The second apparatus is operatively connected to the movable portion.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. THE BRIEF DESCRIPTION OF THE DRAWING

The figures of the drawing are briefly described as follows:

FIG. 11 is a diagrammatic elevational view of the locking pliers of the embodiments of the present invention being utilized by one hand to release the hexagonal workpiece; and FIG. 12 is an enlarged diagrammatic elevational view of the area generally enclosed by the dotted curve identified by ARROW 12 in FIG. 11.

4. THE LIST OF REFERENCE NUMERALS UTILIZED IN THE DRAWING

Figure 1:
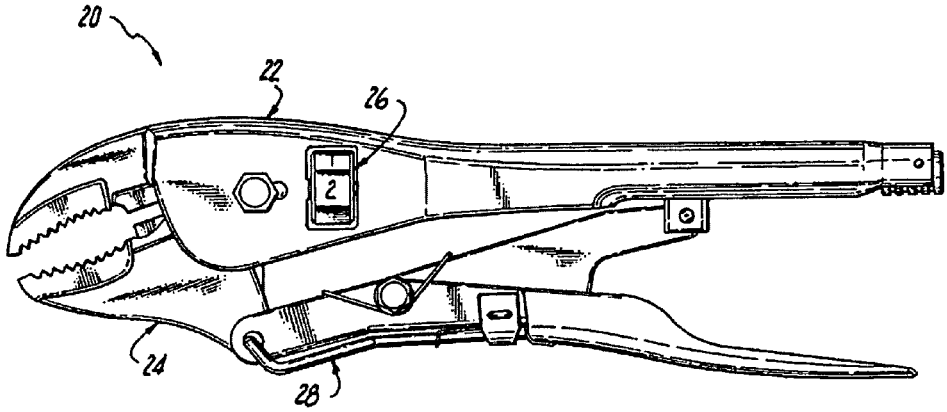
FIG. 1 is a diagrammatic elevational view of the locking pliers of the embodiments of the present invention having its handle and its jaws both being in a closed position.

A. General.

20 locking pliers of embodiments of present invention for being one-handed adjustable, clampable, and releasable.

B. Overall Configuration of Locking Pliers 20.

22 fixed portion

24 movable portion

26 first apparatus for moving movable portion 24 from fixed portion 22 desired amount in order to clamp workpiece using only one hand
28 second apparatus for releasing movable portion 24 from fixed portion 22 in order to release workpiece using only one hand
C. Specific Configuration of Locking Pliers 20.
30 fixed upper jaw of fixed portion 22
32 fixed upper handle of fixed portion 22
34 pivotable lower jaw of movable portion 24
36 pivotable lower handle 36 of movable portion 24
38 pivotable lever
39 hump of pivotable lever 38
40 lower handle pivot pin
42 first lever pivot pin
44 second lever pivot pin
46 lower jaw pivot pin
48 distal end of fixed upper handle 32 of fixed portion 22
50 rotatable externally threaded shaft of first apparatus 26
52 distal end of rotatable externally threaded shaft 50 of first apparatus 26
54 proximal end of rotatable externally threaded shaft 50 of first apparatus 26
56 rotatable adjustment wheel of first apparatus 26
58 both sides of fixed upper handle 32 of fixed portion 22
60 fixed front bushing of first apparatus 26
62 fixed rear bushing of first apparatus 26
64 exposed surfaces of rotatable adjustment wheel 56 of first apparatus 26
66 numerals of rotatable adjustment wheel 56 of first apparatus 26
68 internally threaded block of first apparatus 26
70 lower handle torsion spring of first apparatus 26
71 pair of brass washers of first apparatus 26
72 pivotable release lever of second apparatus 28
73 biasing spring
74 release lever stirrup of second apparatus 28
76 distal end of pivotable release lever 72 of second apparatus 28
78 proximal end of pivotable release lever 72 of second apparatus 28
D. Method of using locking pliers 20.
80 right hand of user 82
82 user
84 thumb of user 82
86 space
85 arrow
87 arrow
88 workpiece
89 arrow
90 arrow
92 arrow
94 arrow
96 arrow
98 arrow
100 arrow
102 arrow
104 arrow
106 arrow

5. THE DETAILED DESCRIPTION OF THE PREFERRED EMBODIMENTS

A. The General.

Referring now to the figures, in which like numerals indicate like parts, and particularly to FIG. 1, which is a diagrammatic elevational view of the locking pliers of the embodiments of the present invention having its handle and its jaws both being in a closed position, the locking pliers of the embodiments of the present invention is shown generally at 20 for being one-handed adjustable, clampable, and releasable.

B. The Overall Configuration of the Locking Pliers 20.

The locking pliers 20 comprises a fixed portion 22, a movable portion 24, a first apparatus 26 for moving the movable portion 24 relative to the fixed portion 22 a desired amount in order to clamp a workpiece using only one hand, and a second apparatus 28 for releasing the movable portion 24 from the fixed portion 22 in order to release the workpiece using only the one hand. The movable portion 24 is movably connected to the fixed portion 22. The first apparatus 26 is operatively connected to the fixed portion 22. The second apparatus 28 is operatively connected to the movable portion 24.

C. The Specific Configuration of the Locking Pliers 20.

Figure 2:
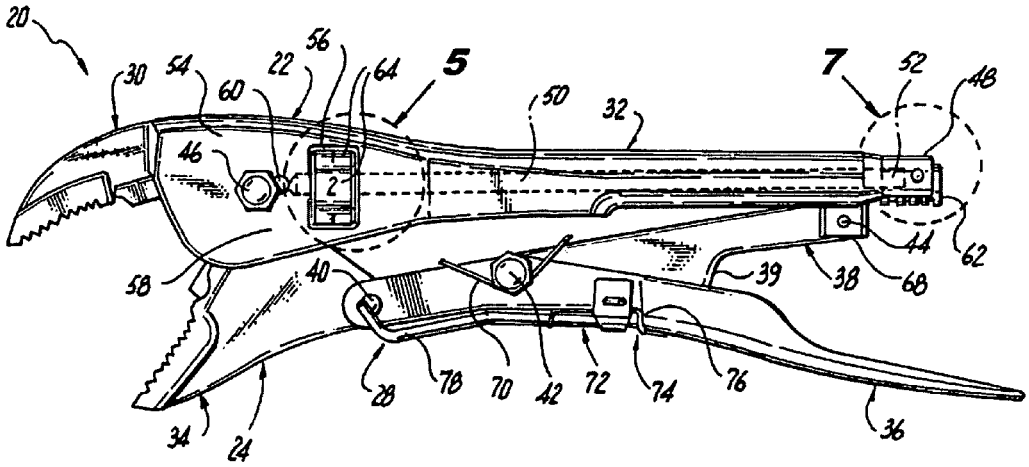
FIG. 2 is a diagrammatic elevational view of the locking pliers of the embodiments of the present invention having its handle in a closed position and its jaws in an open position.
Figure 5:
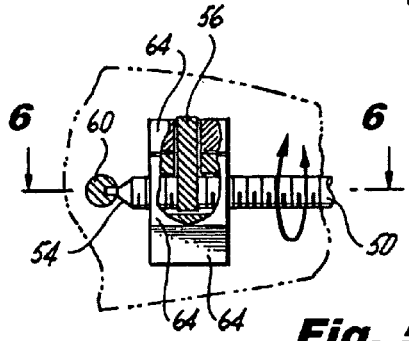
FIG. 5 is an enlarged diagrammatic elevational view, in partial section, of the area generally enclosed by the dotted curve identified by ARROW 5 in FIG. 2.
Figure 7:
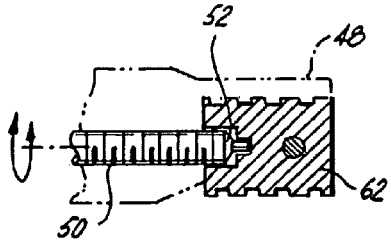
FIG. 7 is an enlarged diagrammatic elevational view, in partial section, of the area generally enclosed by the dotted curve identified by ARROW 7 in FIG. 2.
Figure 6:
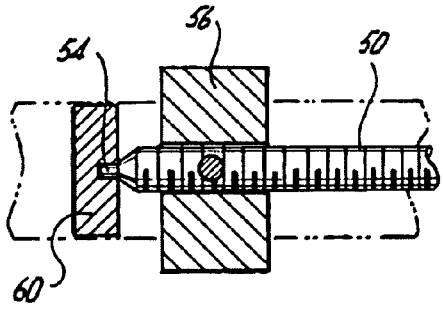
FIG. 6 is an enlarged diagrammatic cross sectional view taken along LINE 6-6 in FIG. 5.
Figure 3:
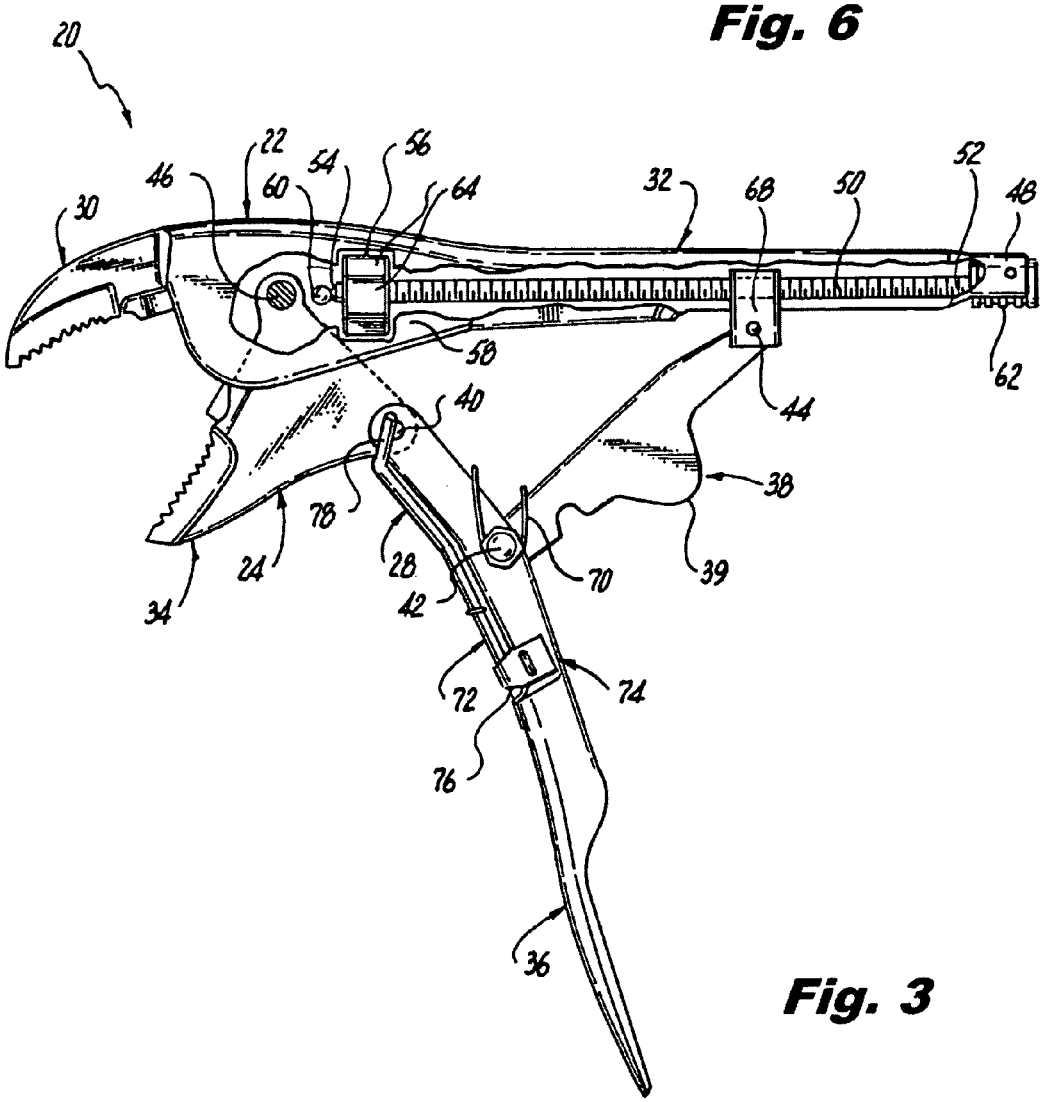
FIG. 3 is a diagrammatic elevational view of the locking pliers of the embodiments of the present invention having its handle and jaws both being in an open position.
Figure 4:
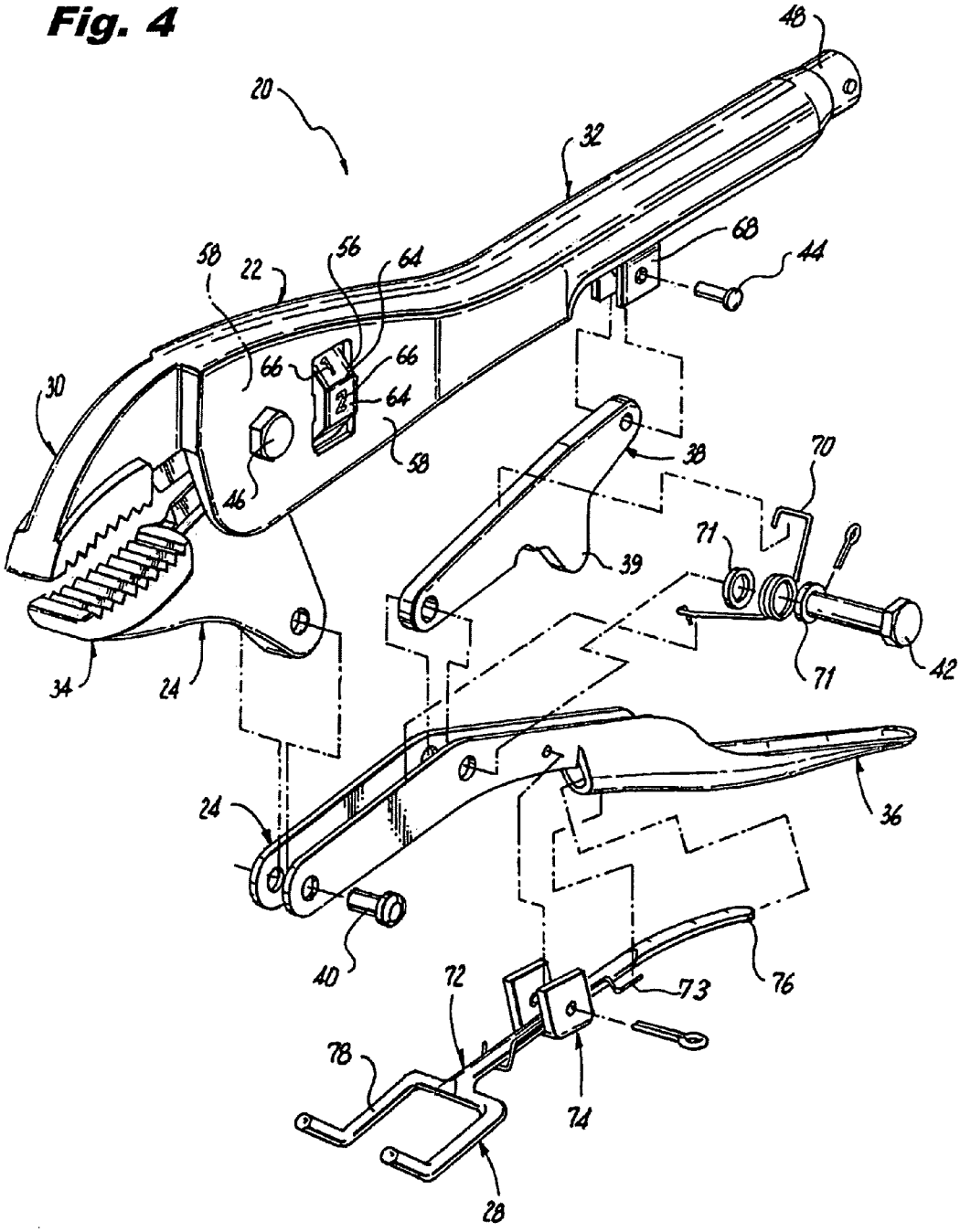
FIG. 4 is an exploded diagrammatic perspective view of the locking pliers of the embodiments of the present invention.

The specific configuration of the locking pliers 20 can best be seen in FIGS. 2-7, which are, respectively, a diagrammatic elevational view of the locking pliers of the embodiments of the present invention having its handle in a closed position and its jaws in an open position, a diagrammatic elevational view of the locking pliers of the embodiments of the present invention having its handle and jaws both being in an open position, an exploded diagrammatic perspective view of the locking pliers of the embodiments of the present invention, an enlarged diagrammatic elevational view, in partial section, of the area generally enclosed by the dotted curve identified by ARROW 5 in FIG. 2, an enlarged diagrammatic cross sectional view taken along LINE 6-6 in FIG. 5, and an enlarged diagrammatic elevational view, in partial section, of the area generally enclosed by the dotted curve identified by ARROW 7 in FIG. 2, and as such, will be discussed with reference thereto.

The fixed portion 22 comprises a fixed upper jaw 30 and a fixed upper handle 32. The fixed upper handle 32 of the fixed portion 22 extends fixedly from the fixed upper jaw 30 of the fixed portion 22.

The movable portion 24 comprises a pivotable lower jaw 34 and a pivotable lower handle 36. The pivotable lower handle 36 of the movable portion 24 extends pivotally from the pivotable lower jaw 34 of the movable portion 24.

The locking pliers 20 further comprises a pivotable lever 38. The pivotable lever 38 has a depending hump 39 and pivotally connects the pivotable lower handle 36 of the movable portion 24 to the fixed upper handle 32 of the fixed portion 22.

The movable portion 24 further comprises a lower handle pivot pin 40. The pivotable lower handle 36 of the movable portion 24 extends pivotally from the pivotable lower jaw 34 of the movable portion 24 by the lower handle pivot pin 40.

The locking pliers 20 further comprises a first lever pivot pin 42 and a second lever pivot pin 44. The first lever pivot pin 42 and the second lever pivot pin 44 pivotally connect the pivotable lever 38 to the pivotable lower handle 36 of the movable portion 24 and the fixed upper handle 32 of the fixed portion 22, respectively.

The locking pliers 20 further comprises a lower jaw pivot pin 46. The lower jaw pivot pin 46 pivotally connects the pivotable lower jaw 34 of the movable portion 24 to the fixed upper jaw 30 of the fixed portion 22.

The fixed upper handle 32 of the fixed portion 22 has a distal end 48 and the first apparatus 26 comprises a rotatable externally threaded shaft 50. The rotatable externally threaded shaft 50 of the first apparatus 26 has a distal end 52, a proximal end 54, and extends rotatably and internally through the fixed upper handle 32 of the fixed portion 22 at the distal end 52 thereof from the distal end 48 of the fixed upper handle 32 of the fixed portion 22 to the proximal end 54 thereof just short of the lower jaw pivot pin 46.

The first apparatus 26 further comprises a rotatable adjustment wheel 56. The rotatable adjustment wheel 56 of the first apparatus 26 is manually rotatable by either hand by virtue of sticking out from both sides 58 of the fixed upper handle 32 of the fixed portion 22 and has the proximal end 54 of the rotatable externally threaded shaft 50 of the first apparatus 26 pass slightly and fixedly therethrough.

The first apparatus 26 further comprises a fixed front bushing 60. The fixed front bushing 60 of the first apparatus 26 rotatably receives the proximal end 54 of the rotatable externally threaded shaft 50 of the first apparatus 26, and is disposed internally between the lower jaw pivot pin 46 and the rotatable adjustment wheel 56 of the first apparatus 26.

The first apparatus 26 further comprises a fixed rear bushing 62. The fixed rear bushing 62 of the first apparatus 26 rotatably receives the distal end 52 of the rotatable externally threaded shaft 50 of the first apparatus 26, and is disposed internally at the distal end 48 of the fixed upper handle 32 of the fixed portion 22.

The rotatable adjustment wheel 56 of the first apparatus 26 has a polygon shape, exposed surfaces 64, and numerals 66. The numerals 66 of the rotatable adjustment wheel 56 of the first apparatus 26 are disposed, respectively, on the exposed surfaces 64 of the rotatable adjustment wheel 56 of the first apparatus 26, and provide a reference for spacing the pivotable lower jaw 34 of the movable portion 24 relative to the fixed upper jaw 30 of the fixed portion 22 so as to allow each numeral 66 of the rotatable adjustment wheel 56 of the first apparatus 26 to represent a specific spacing of the pivotable lower jaw 34 of the movable portion 24 relative to the fixed upper jaw 30 of the fixed portion 22 for latter use.[1,2]

[1] See, In re Miller, 164 USPQ 46, 49 (CCPA 1969) ("When the printed matter is associated with a structural article for some utilitarian purpose, the fact that printed matter by itself is not patentable subject matter, because non-statutory, is no reason for ignoring it when the claim is directed to a combination." [Emphasis added]); In re Bernhart and Fetter, 163 USPQ 611 (CCPA 1969) ("[E]ven though certain items are nonstatutory by themselves, it is proper to include them and rely on them for novelty and unobviousness if combined with other items which are in the statutory class [even though] the other 'items' may all be old."[Emphasis added]).

[2] Similar in concept to automotive memory seat positions.

The first apparatus 26 further comprises an internally threaded block 68. The internally threaded block 68 of the first apparatus 26 threadably rides on the rotatable externally threaded shaft 50 of the first apparatus 26 when the rotatable adjustment wheel 56 of the first apparatus 26 is rotated by the one hand.

The second lever pivot pin 44 pivotally connects the pivotable lever 38 to the internally threaded block 68 of the first apparatus 26 so as the rotatable externally threaded shaft 50 of the first apparatus 26 is rotated by the rotatable adjustment wheel 56 of the first apparatus 26 by the one hand, the internally threaded block 68 of the first apparatus 26 threadably rides on the rotatable externally threaded shaft 50 of the first apparatus 26 causing the pivotable lever 38 to move the pivotable lower jaw 34 of the movable portion 24 relative to the fixed upper jaw 30 of the fixed portion 22.

The first apparatus 26 further comprises a lower handle torsion spring 70. The lower handle torsion spring 70 of the first apparatus 26 is disposed around the first lever pivot pin 42 to bias the pivotable lower handle 36 of the movable portion 24 to the pivotable lever 38 so as to prevent the pivotable lower handle 36 of the movable portion 24 from freely depending.

The first apparatus 26 further comprises a pair of brass washers 71. The pair of brass washers 71 of the first apparatus 26 are disposed around the first lever pivot pin 42 and straddle, and relieve stress in, the lower handle torsion spring 70 of the first apparatus 26.

The second apparatus 28 comprises a pivotable release lever 72, a biasing spring 73 and a release lever stirrup 74. The pivotable release lever 72 of the second apparatus 28 has a distal end 76 and a proximal end 78. The proximal end 78 of the pivotable release lever 72 of the second apparatus 28 is bifurcated to freely staddle the lower handle pivot pin 40 so as to be engagable by either hand, while the distal end 76 of the pivotable release lever 72 of the second apparatus 28 is pivotally connected through the pivotable lower handle 36 of the movable portion 24 by the release lever stirrup 74 of the second apparatus 28 that is disposed just rearwardly of the lower jaw pivot pin 46 so when the proximal end 78 of the pivotable release lever 72 of the second apparatus 28 is pushed down, the distal end 76 of the pivotable release lever 72 of the second apparatus 28 pivots via the release lever stirrup 74 of the second apparatus 28 and pushes on the depending hump 39 of the pivotable lever 38 causing the pivotable lower handle 36 of the movable portion 24 to release and move away from the fixed upper handle 32 of the fixed portion 22.

D. The Method of Using the Locking Pliers 20.

The method of using the locking pliers 20 can best be seen in FIGS. 8-12, which are, respectively, a diagrammatic elevational view of the locking pliers of the embodiments of the present invention being utilized by one hand to be simultaneously held and have the space between the jaws adjusted as it approaches a hexagonal workpiece, a diagrammatic elevational view of the locking pliers of the embodiments of the present invention being utilized by one hand to be simultaneously held and have the space between the jaws adjusted to engage the hexagonal workpiece, a diagrammatic elevational view of the locking pliers of the embodiments of the present invention being utilized by one hand to be simultaneously held and rotated to rotate the hexagonal workpiece, a diagrammatic elevational view of the locking pliers of the embodiments of the present invention being utilized by one hand to release the hexagonal workpiece, and an enlarged diagrammatic elevational view of the area generally enclosed by the dotted curve identified by ARROW 12 in FIG. 11, and as such, will be discussed with reference thereto.

Figure 8:
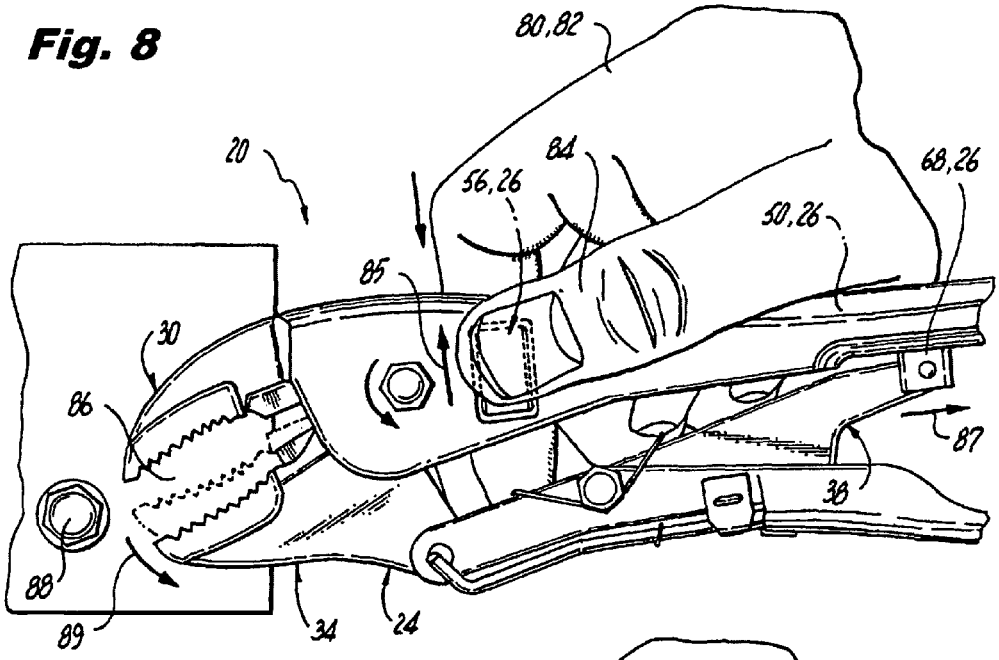
FIG. 8 is a diagrammatic elevational view of the locking pliers of the embodiments of the present invention being utilized by one hand to be simultaneously held and have the space between the jaws adjusted as it approaches a hexagonal workpiece.

As shown in FIG. 8, the locking pliers 20 is held in the right hand 80 of a user 82, which could also have been the left hand, since the locking pliers 20 can be used by only one hand.

The thumb 84 of the user 82 rotates the rotatable adjustment wheel 56 of the first apparatus 26 upwardly in a direction of arrow 85, causing the internally threaded block 68 of the first apparatus 26 to threadably ride rearwardly on the rotatable externally threaded shaft 50 of the first apparatus 26 in a direction of arrow 87, causing the pivotable lever 38 to move the pivotable lower jaw 34 of the movable portion 24 away from the fixed upper jaw 30 of the fixed portion 22 in a direction of arrow 89 so as to form a space 86 therebetween.

Figure 9:
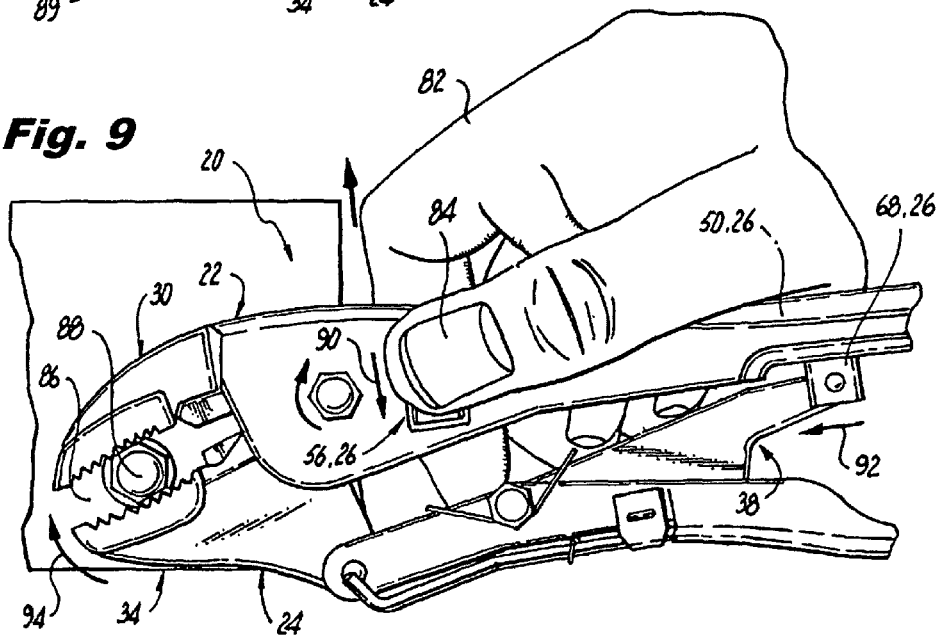
FIG. 9 is a diagrammatic elevational view of the locking pliers of the embodiments of the present invention being utilized by one hand to be simultaneously held and have the space between the jaws adjusted to engage the hexagonal workpiece.

As shown in FIG. 9, the space 86 receives a workpiece 88, and the thumb 84 of the user 82 rotates the rotatable adjustment wheel 56 of the first apparatus 26 downwardly in a direction of arrow 90, causing the internally threaded block 68 of the first apparatus 26 to threadably ride forwardly on the rotatable externally threaded shaft 50 of the first apparatus 26 in a direction of arrow 92, causing the pivotable lever 38 to move the pivotable lower jaw 34 of the movable portion 24 towards the fixed upper jaw 30 of the fixed portion 22 in a direction of arrow 94, thereby closing the space 86 so as to capture the workpiece 88 therebetween.

Figure 10:
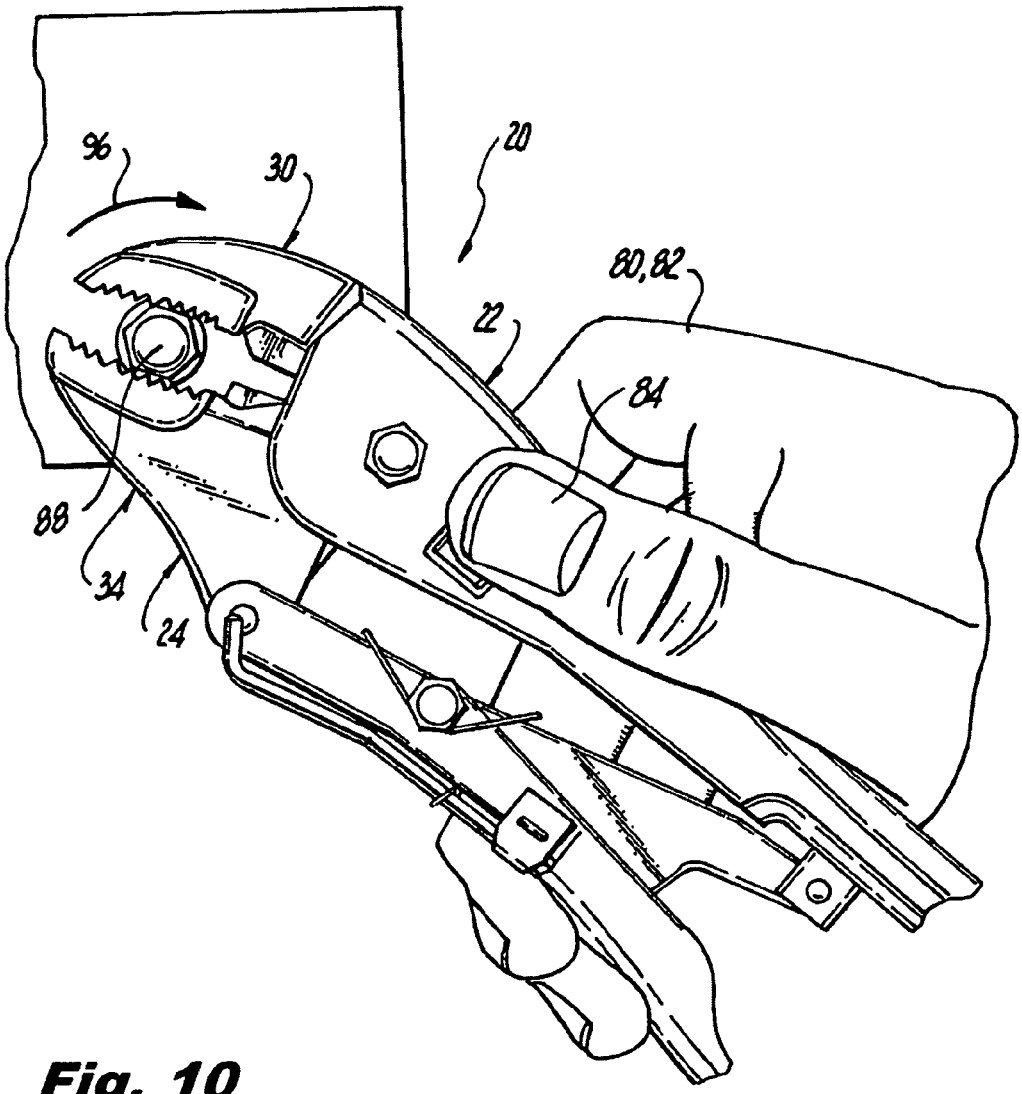
FIG. 10 is a diagrammatic elevational view of the locking pliers of the embodiments of the present invention being utilized by one hand to be simultaneously held and rotated to rotate the hexagonal workpiece.

As shown in FIG. 10, with the workpiece 88 captured between the pivotable lower jaw 34 of the movable portion 24 and the fixed upper jaw 30 of the fixed portion 22, the hand 80 of the user 82 rotates the locking pliers 20 clockwise in a direction of arrow 96, causing the workpiece 88 to rotate clockwise.

As shown in FIGS. 11 and 12, the thumb 84 of the user 82 pushes down on the proximal end 78 of the pivotable release lever 72 of the second apparatus 28 in a direction, of arrow 98, causing the distal end 76 of the pivotable release lever 72 of the second apparatus 28 to pivot upwardly in a direction of arrow 100, via the release lever stirrup 74 of the second apparatus 28, and pushes on the depending hump 39 of the pivotable lever 38, causing the pivotable lower handle 36 of the movable portion 24 to release and move away from the fixed upper handle 32 of the fixed portion 22, and with further moving of the pivotable lower handle 36 of the movable portion 24 away from the fixed upper handle 32 of the fixed portion 22 in a direction of arrow 102, the pivotable lower jaw 34 of the movable portion 24 is caused to move away from the fixed upper jaw 30 of the fixed portion 22 in a direction of arrow 104, thereby opening the space 86 and freeing the workpiece 88 outwardly in a direction of arrow 106.

E. The Impressions.

It will be understood that each of the elements described above or two or more together may also find a useful application in other types of constructions differing from the types described above.

While the embodiments of the present invention have been illustrated and described as embodied in locking pliers for being one-handed adjustable, clampable, and releasable, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. Locking pliers for being one-handed adjustable, clampable, and releasable, comprising:

a) a fixed portion;

b) a movable portion;

c) first means for moving said movable portion relative to said fixed portion a desired amount in order to clamp a workpiece using only one hand; and d) second means for releasing said movable portion from said fixed portion in order to release the workpiece using only the one hand;

e) pivotable lever;

f) a first lever pivot pin; and g) a second lever pivot pin;

wherein said movable portion is movably connected to said fixed portion;

wherein said first means is operatively connected to said fixed portion;

wherein said second means is operatively connected to said movable portion;

wherein said fixed portion comprises:

a) a fixed upper jaw; and b) a fixed upper handle;

wherein said fixed upper handle of said fixed portion extends fixedly from said fixed upper jaw of said fixed portion;

wherein said movable portion comprises:

a) a pivotable lower jaw; and b) a pivotable lower handle;

wherein said pivotable lower handle of said movable portion extends pivotally from said pivotable lower jaw of said movable portion;

wherein said pivotable lever has a depending hump;

wherein said pivotable lever pivotally connects said pivotable lower handle of said movable portion to said fixed upper handle of said fixed portion wherein said first lever pivot pin and said second lever pivot pin pivotally connect said pivotable lever to said pivotable lower handle of said movable portion and said fixed upper handle of said fixed portion, respectively;

wherein said first means comprises a lower handle torsion spring; and wherein said lower handle torsion spring of said first means is disposed around said first lever pivot pin to bias said pivotable lower handle of said movable portion to said pivotable lever so as to prevent said pivotable lower handle of said movable portion from freely depending.

2. The pliers of claim 1, wherein said movable portion comprises a lower handle pivot pin; and wherein said pivotable lower handle of said movable portion extends pivotally from said pivotable lower jaw of said movable portion by said lower handle pivot pin.

3. The pliers of claim 2, further comprising a lower jaw pivot pin; and wherein said lower jaw pivot pin pivotally connects said pivotable lower jaw of said movable portion to said fixed upper jaw of said fixed portion.

4. The pliers of claim 3, wherein said fixed upper handle of said fixed portion has a distal end;

wherein said first means comprises a rotatable externally threaded shaft;

wherein said rotatable externally threaded shaft of said first means has:

a) a distal end; and b) a proximal end;

wherein said rotatable externally threaded shaft of said first apparatus means extends rotatably and internally through said fixed upper handle of said fixed portion, at said distal end thereof from said distal end of said fixed upper handle of said fixed portion to said proximal end thereof, just short of said lower jaw pivot pin.

5. The pliers of claim 4, wherein said first means comprises a rotatable adjustment wheel;

wherein said rotatable adjustment wheel of said first means is manually rotatable by either hand by virtue of sticking out from both sides of said fixed upper handle of said fixed portion; and wherein said rotatable adjustment wheel of said first means has said proximal end of said rotatable externally threaded shaft of said first means pass slightly and fixedly therethrough.

6. The pliers of claim 5, wherein said first means comprises a fixed front bushing;

wherein said fixed front bushing of said first means rotatably receives said proximal end of said rotatable externally threaded shaft of said first means; and wherein said fixed front bushing of said first means is disposed internally between said lower jaw pivot pin and said rotatable adjustment wheel of said first means.

7. The pliers of claim 4, wherein said first means comprises a fixed rear bushing;

wherein said fixed rear bushing of said first means rotatably receives said distal end of said rotatable externally threaded shaft of said first means; and wherein said fixed rear bushing of said first means is disposed internally at said distal end of said fixed upper handle of said fixed portion.

8. The pliers of claim 5, wherein said rotatable adjustment wheel of said first means has:

a) a polygon shape;

b) exposed surfaces; and c) numerals;

wherein said numerals of said rotatable adjustment wheel of said first means are disposed, respectively, on said exposed surfaces of said rotatable adjustment wheel of said first means; and wherein said numerals of said rotatable adjustment wheel of said first means provide a reference for spacing said pivotable lower jaw of said movable portion relative to said fixed upper jaw of said fixed portion so as to allow each numeral of said rotatable adjustment wheel of said first means to represent a specific spacing of said pivotable lower jaw of said movable portion relative to said fixed upper jaw of said fixed portion for latter use.

9. The pliers of claim 5, wherein said first means comprises an internally threaded block; and wherein said internally threaded block of said first means threadably rides on said rotatable externally threaded shaft of said first means when said rotatable adjustment wheel of said first means is rotated by the one hand.

10. The pliers of claim 9, wherein said second lever pivot pin pivotally connects said pivotable lever to said internally threaded block of said first means so as said rotatable externally threaded shaft of said first means is rotated by said rotatable adjustment wheel of said first means by the one hand, said internally threaded block of said first means threadably rides on said rotatable externally threaded shaft of said first means causing said pivotable lever to move said pivotable lower jaw of said movable portion relative to said fixed upper jaw of said fixed portion.

11. The pliers of claim 1, wherein said first means comprises a pair of brass washers;

wherein said pair of brass washers of said first means are disposed around said first lever pivot pin; and wherein said pair of brass washers of said first means straddle, and relieve stress in, said lower handle torsion spring of said first means.

12. The pliers of claim 3, wherein said second means comprises:

a) a pivotable release lever; and b) a release lever stirrup.

13. The pliers of claim 12, wherein said pivotable release lever of said second means has:

a) a distal end; and b) a proximal end;

wherein said proximal end of said pivotable release lever of said second means is bifurcated to freely staddle said lower handle pivot pin so as to be engagable by either hand, while said distal end of said pivotable release lever of said second means is pivotally connected to said pivotable lower handle of said movable portion by said release lever stirrup of said second means, that is disposed just rearwardly of said lower jaw pivot pin, so when said proximal end of said pivotable release lever of said second means is pushed down, said distal end of said pivotable release lever of said second means pivots, via said release lever stirrup of said second means, and pushes on said depending hump of said pivotable lever causing said pivotable lower handle of said movable portion to release and move away from said fixed upper handle of said fixed portion.

* * * * *